US008926923B2

(12) United States Patent
Blomberg

(10) Patent No.: US 8,926,923 B2
(45) Date of Patent: Jan. 6, 2015

(54) BIOCONTAINER TRANSFER ASSEMBLY

(75) Inventor: Max D. Blomberg, Ventura, CA (US)

(73) Assignee: Meissner Filtration Products, Inc., Camarillo, CA (US)

( * ) Notice: Subject to any disclaimer, the term of this patent is extended or adjusted under 35 U.S.C. 154(b) by 19 days.

(21) Appl. No.: 13/472,380

(22) Filed: May 15, 2012

(65) Prior Publication Data

US 2013/0308881 A1 Nov. 21, 2013

(51) Int. Cl.
*A61J 1/10* (2006.01)

(52) U.S. Cl.
USPC ..... 422/555; 435/304.1; 604/408

(58) Field of Classification Search
USPC ..... 422/547, 555; 435/289.1, 304.1; 604/408, 409, 415, 416
See application file for complete search history.

(56) References Cited

U.S. PATENT DOCUMENTS 4,049,033 A * 9/1977 Ralston, Jr. ..... 604/408
4,479,989 A * 10/1984 Mahal ..... 428/35.5
4,598,834 A * 7/1986 Singletary, Jr. ..... 215/232
4,639,251 A * 1/1987 Kirkland ..... 604/260
5,188,610 A * 2/1993 Rains ..... 604/183
5,307,955 A * 5/1994 Viegas ..... 222/107
5,324,233 A * 6/1994 Owensby et al. ..... 493/190
6,403,369 B1 * 6/2002 Wood ..... 435/304.1
6,572,268 B2 * 6/2003 Ichikawa ..... 383/120
6,729,369 B2 * 5/2004 Neas et al. ..... 141/231
2005/0282269 A1 * 12/2005 Proulx ..... 435/296.1

* cited by examiner

*Primary Examiner* — Jill Warden
*Assistant Examiner* — Dwayne K Handy
(74) *Attorney, Agent, or Firm* — Christie, Parker & Hale, LLP

(57) ABSTRACT

The present invention relates to pharmaceutical fluids, and more particularly to a flexible container for aseptic transfer and/or mixing of pharmaceutical fluids. A biocontainer for the transfer of pharmaceutical fluids includes a flexible layer divided by a fold line into a front face and a rear face. The layer is folded about the fold line such that the front face and the rear face are facing each other to define an interior space between them. The biocontainer also includes a seam that connects the front and rear faces to each other to close the interior space. A fill port is also provided to communicate with the interior space. This fill port is intersected by the fold line.

23 Claims, 9 Drawing Sheets

BIOCONTAINER TRANSFER ASSEMBLY

FIELD OF THE INVENTION

The present invention relates to pharmaceutical fluids, and more particularly to a flexible container for aseptic transfer and/or mixing of pharmaceutical fluids.

BACKGROUND

In the pharmaceutical industry, various types of fluids are used for the preparation, transfer, and storage of pharmaceutical compositions, including drugs, drug components and intermediates, cleaning solutions, and other process solutions and fluids. These fluids often need to be transferred from a storage container to a pharmaceutical system. A transfer container may be used to transfer these fluids, such as, for example, to transfer a cell growth media from a storage bottle to a bioreactor. However, fluid can be lost during the transfer, for example, if filling or draining is difficult or if the transfer container includes a significant hold-up volume.

Additionally, it is often important to maintain the sterility of these fluids during storage and transfer. Accordingly, the transfer of such a fluid first from the storage container and then to the bioreactor (or other end use application) needs to be conducted in an aseptic manner.

Accordingly, there is a need for a flexible assembly that facilitates aseptic fluid transfer, filling, mixing, and draining of pharmaceutical fluids in a non-controlled environment.

SUMMARY

The present invention relates to pharmaceutical fluids, and more particularly to a flexible container for aseptic mixing and/or transfer of pharmaceutical fluids. In one embodiment, a biocontainer assembly includes a flexible biocontainer with a port that is designed for easy filling. The filling port is located at or near the top of the biocontainer, where the front and rear faces of the biocontainer meet. The location of the port creates a separation between the front and rear faces below the port, forming a void or open space between the two faces. This initial void facilitates ease of filling and mixing of powders and fluids into the biocontainer. The port, the front face, and the rear face create a three-dimensional shape at the top of the biocontainer. Further, the front and rear faces create a two-dimensional shape at the bottom of the biocontainer, to reduce any hold-up volume in the container when it is drained. As a result, the biocontainer reduces the amount of fluid remaining in the biocontainer after draining, and is easy to fill. The biocontainer may be referred to as having a blended two-dimensional and three-dimensional shape.

In one embodiment a biocontainer for the transfer of phatinaceutical fluids includes a flexible layer divided by a fold line into a front face and a rear face. The layer is folded about the fold line such that the front face and the rear face are facing each other to define an interior space between them. The biocontainer also includes a seam that connects the front and rear faces to each other to close the interior space. A fill port is also provided to communicate with the interior space. This fill port is intersected by the fold line.

In one embodiment, a biocontainer for the transfer of pharmaceutical fluids includes a flexible container defining an interior space, a three-dimensional fill port providing fluid access to the interior space, and a two-dimensional drain port providing fluid access to the interior space.

In one embodiment, a method for manufacturing a biocontainer for the transfer of pharmaceutical fluids includes a method for defining and shaping a flexible film. The method includes defining a perimeter of the flexible film, and forming an opening in the flexible film. A fold line is created that intersects the opening. The method includes folding the flexible film about the fold line, creating front and rear folded portions. The method then includes attaching the front and rear folded portions to each other to define an interior space, and removably closing the opening, such as by attaching a screw cap.

DETAILED DESCRIPTION

The present invention relates to pharmaceutical fluids and more particularly to a flexible container for aseptic transfer and/or mixing of pharmaceutical fluids. In one embodiment, a biocontainer assembly includes a flexible biocontainer with a port that is designed for easy filling. The filling port is located at or near the top of the biocontainer, where the front and rear faces of the biocontainer meet. The location of the port creates a separation between the front and rear faces below the port, forming a void or open space between the two faces. This initial void facilitates filling and mixing of powders and fluids into the biocontainer. The port, the front face, and the rear face create a three-dimensional shape at the top of the biocontainer. Further, the front and rear faces create a two-dimensional shape at the bottom of the biocontainer, to reduce any hold-up volume in the container when it is drained. As a result, the biocontainer reduces the amount of fluid remaining in the biocontainer after draining, and is easy to fill. The biocontainer may be referred to as having a blended two-dimensional and three-dimensional shape.

Figure 1:
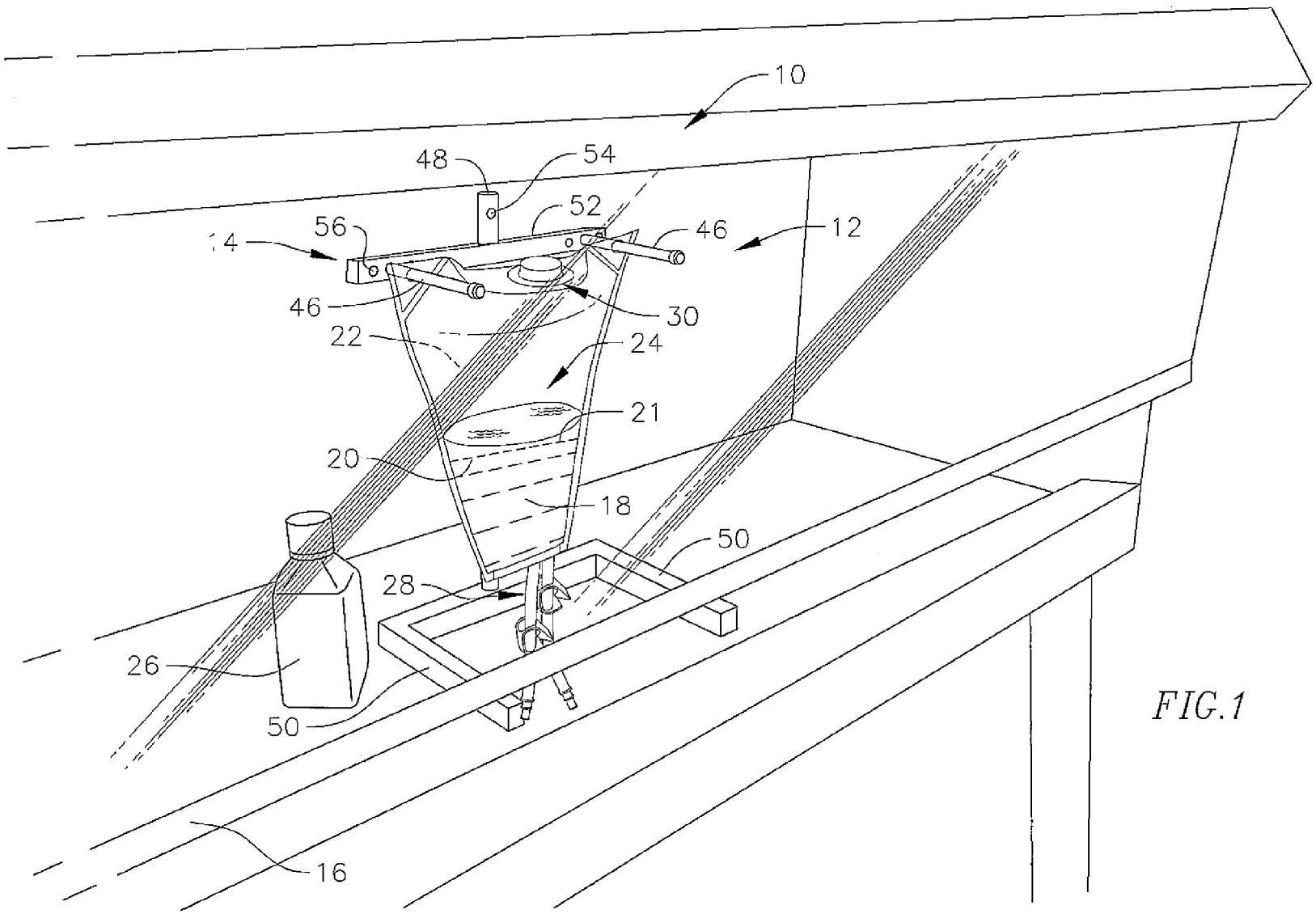
FIG. 1 is a perspective view of a biocontainer assembly according to an embodiment of the invention.

A biocontainer assembly 10 according to an embodiment of the invention is shown in FIG. 1. The biocontainer assembly 10 includes a flexible biocontainer 12 supported on a stand 14 within a controlled environment or isolator 16, such as a laminar flow hood. The stand 14 supports the biocontainer 12 in an upright position, for easy filling. In the figure, the biocontainer 12 is partially filled with a fluid 18.

In one embodiment, the biocontainer 12 is used to transfer pharmaceutical fluids from a supply source to an end-use application such as a bioreactor. For example, in the embodiment of FIG. 1, the fluid 18 is filled into the biocontainer 12 from a supply source such as a rigid tank or bottle 26. Pharmaceutical fluids such as cell culture media, drug components, cleaning solutions, reagents, buffers, supplements, and process fluids may be supplied from the manufacturer in a rigid container such as the bottle 26, for ease of manufacturing, shipment, and storage. However, the rigid bottle 26 or other supply source may not be vented, and may be difficult to drain. It may also lack aseptic connectors as needed to transfer the fluid 18 to the final end-use application. Additionally, a precise amount of fluid may need to be measured and/or mixed for a particular end-use application.

Accordingly, a transfer container such as the biocontainer 12 is used to transfer the fluid 18 from the supply bottle 26 (or other source) and prepare the fluid 18 for an end-use application. The biocontainer 12 may be placed within the controlled environment 16 to allow the filling and/or mixing of the fluid 18 to take place within an aseptic environment. For example, in one embodiment the controlled environment 16 includes a laminar flow hood with a downward sterile gas flow, to prevent any external contaminants from entering the hood. In one embodiment, the hood includes a filter such as a HEPA filter, providing a sterile environment within the hood. Once the fluid 18 is filled into the biocontainer, the biocontainer is closed, within the laminar flow hood, to seal the fluid 18 from the external environment. The biocontainer may then be removed from the laminar flow hood and transferred in a non-controlled environment to its particular end-use. The biocontainer 12 includes tubes, connectors, or other flow conduits (collectively or individually referred to herein as "flow paths" or "fluid paths" 28) that enable aseptic connectivity. The flow paths 28 may include aseptic connectors or may enable connection in an aseptic manner. The connectors or other flow paths 28 are then used to connect the biocontainer to the end-use application. The biocontainer provides an aseptic, closed fluid path for the fluid 18, even when the outer environment is non-sterile. A closed fluid path is one that does not have any external environmental exposures. The biocontainer may also include ports for mixing by fluid recirculation, as described more fully below.

Figure 2:
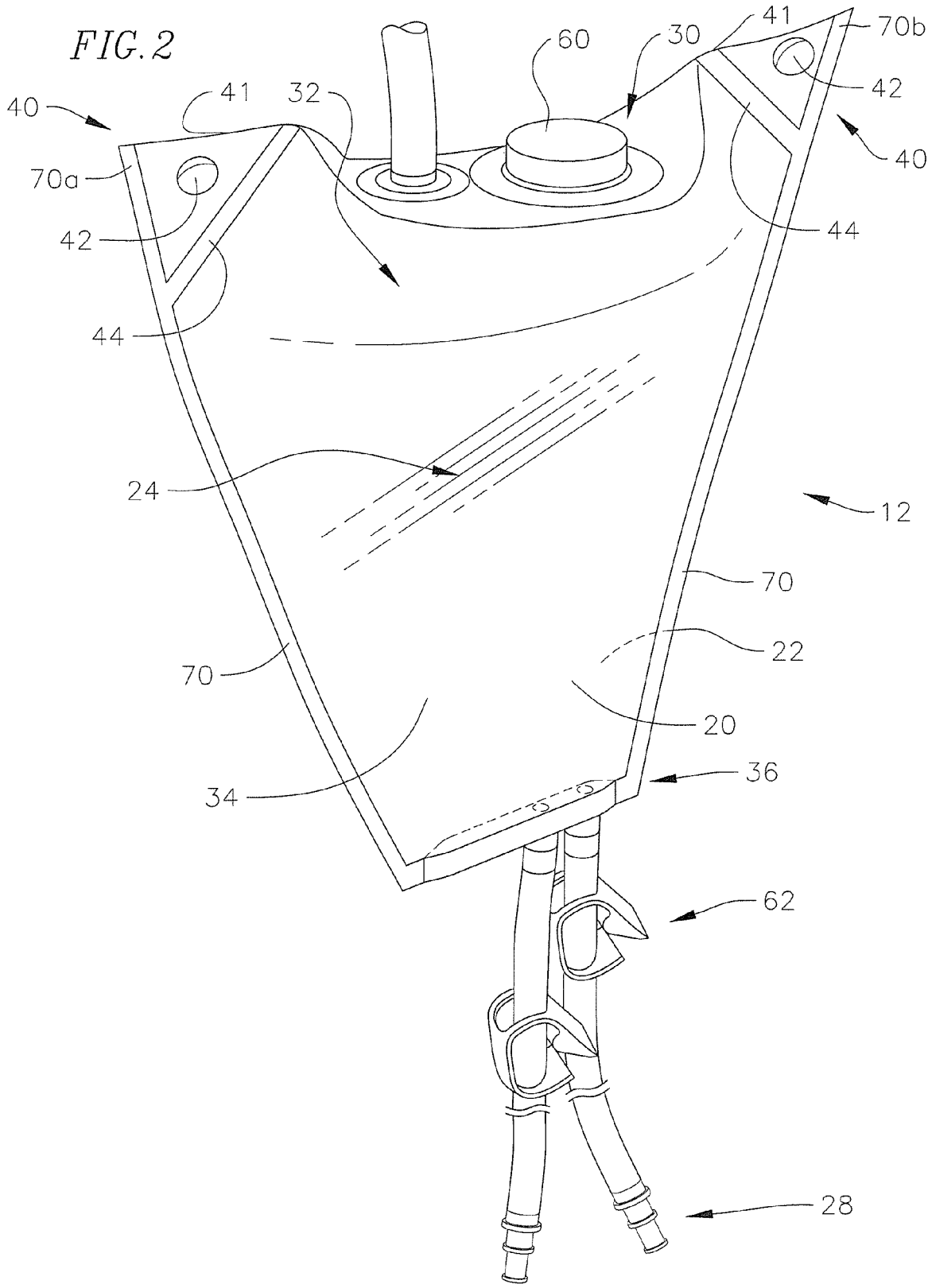
FIG. 2 is a front perspective view of a biocontainer assembly according to an embodiment of the invention.

Referring to FIGS. 1 and 2, the biocontainer 12 is a flexible container including two flexible faces—a front face 20 and a rear face 22. The two faces 20, 22 are secured to each other at their peripheries, and unsecured between their peripheries, forming an interior space 24 to accept a fluid such as the fluid 18. The biocontainer 12 also includes a fill opening or port 30 at or near the top end of the biocontainer. The port 30 may be referred to as a top port or a fill port. The port 30 provides fluid access to the interior space 24 between the front and rear faces 20, 22.

As mentioned above, the biocontainer 12 has a unique shape that blends both two-dimensional and three-dimensional features. In FIG. 2, the biocontainer 12 is shown empty, unfilled. The front and rear faces 20, 22 are separated from each just below the top port 30, forming an initial void 32. The void 32 is formed by the geometry of the port 30 and its location with respect to the front and rear faces 20, 22. The port 30 separates the two faces and prevents them from coming together in the area of the void 32. Below the void 32, in the lower portion 34 of the biocontainer, the front and rear faces 20, 22 come together and contact each other. The contact between the two faces is indicated by the dotted lines in FIG. 1. Below the upper dotted line 21, the front and rear faces 20, 22 contact each other and close the interior space 24, allowing this portion of the biocontainer to lie flat on its side for storage. Above the upper dotted line, the front and rear faces 20, 22 separate from each other and diverge to opposite sides of the port 30, thereby forming the void 32.

The biocontainer 12 transitions from a three-dimensional shape at the area of the void 32 to a flat, two-dimensional shape in the lower portion 34, below the void. This blended geometry is useful for storing, filling, and draining the biocontainer 12. During storage, the lower portion 34 of the biocontainer is flat, occupying minimal storage space. During filling, the void 32 creates an open space for fluid, powder, or other components to be deposited into the biocontainer through the port 30. The void 32 is formed by the geometry of the biocontainer, and does not require additional manipulation by the user to separate the two faces 20, 22 from each other to form a void. The two faces 20, 22 can be difficult to separate when pressed together during shipment or storage, and thus it can be difficult for a user to separate the two faces and open the biocontainer in order to fill it with powder or fluid. The void 32 facilitates this process. Additionally, during draining, the lower portion 34 of the biocontainer provides minimal, or even zero, hold-up volume, because the lower portion 34 can be substantially flattened. Hold-up volume is the undrained volume within the biocontainer, where fluids such as the fluid 18 (FIG. 1) remain after draining. Hold-up volume leads to lost and wasted fluid, which increases costs and reduces measuring accuracy. The two-dimensional shape of the lower portion 34 of the biocontainer 12 enables the biocontainer 12 to be flattened to drain completely, such as by gravity or the use of a peristaltic pump. In one embodiment, the biocontainer 12 provides a hold-up volume of less than 5 mL, and in another embodiment less than 3 mL, and in another embodiment less than 1 mL.

The biocontainer 12 shown in FIGS. 1 and 2 also includes a drain port 36 at the bottom of the interior space 24, opposite the top port 30. The drain port 36 is located at the bottom of the two-dimensional lower portion 34, where the front and rear faces 20, 22 meet to close the interior space 24. In one embodiment, the drain port 36 is a two-dimensional port such as a boat port or tube stubs, which can be welded into the seam of the flexible container.

In one embodiment, the drain port 36 is an end-port, located at the end seam of the front and rear faces 20, 22. The drain port 36 is attached to the two faces 20, 22 at their free bottom edges. This end port may be referred to as a linear port or a two-dimensional port, as it is defined by the edges where the front and rear faces 20, 22 meet. The two-dimensional port 36 is located at the lower seam of the biocontainer. Although this port is referred to as a two-dimensional port, it should be understood that the port is not completely flat, and it necessarily occupies some thickness in a third dimension. The port is referred to as two-dimensional due to its position along the lower seam, at the edge of the two faces 20, 22, oriented in a direction along a line where the two faces 20, 22 meet. However the drain port 36 does occupy a thickness between the two faces 20, 22 in order to provide the drain functionality. Accordingly the two faces 20, 22 are separated a small distance by this drain port 36, and thus a small hold-up volume may be present. This hold-up volume is generally dependent on the overall size of the biocontainer; however, it is typically less than 1.5 ml.

In one embodiment, the fill port 30 is a face port, as it is located within the faces 20, 22, rather than on an edge or seam. The face port may be referred to as a three-dimensional port.

In one embodiment, the biocontainer includes an interface 40 for interacting with a mount, stand, or other support structure, such as the support stand 14. In one embodiment, the interface 40 includes a pair of ears 41 at the upper outer corners of the biocontainer 12. Each ear 41 includes an opening 42 formed through the front and back faces 20, 22, to provide an opening through the biocontainer. The interior fluid space 24 is sealed from the openings 42 by seams 44. The openings 42 interact with a support structure to support the biocontainer 12 in a vertical, upright position, as shown in FIG. 1. In FIG. 1, the stand 14 includes two projecting arms 46 that extend outward from the stand 14. The arms 46 pass through the openings 42 to hang the biocontainer 12 on the stand. In one embodiment, the stand 14 is adjustable in height and width, so that it can be adjusted to accommodate biocontainers of various sizes. For example, in FIG. 1, the stand 14 includes a includes a leg 48 extending upwardly from two feet 50. The arms 46 are supported on a crossbar 52 that is mounted to the leg 48. The leg 48 includes openings 54 for receipt of the crossbar 52 at various heights above the feet 50. The crossbar 52 also includes openings 56 for receipt of the arms 46 at various widths apart from each other. These features enable the geometry of the stand 14 to be adjusted to support biocontainers of different shapes and sizes.

The biocontainer 12 in FIG. 1 is supported by the ears 41 on the stand 14, to raise the biocontainer 12 into an upright position with the top port 30 accessible. In this position, the top port 30 can be accessed to fill liquid and/or powder into the biocontainer within the isolator 16.

In one embodiment, the top port 30 includes a cap 60 such as a screw cap with threads that engage corresponding threads in the port 30. The cap 60 is removable from the port 30 to open the port for access into the interior space 24, and the cap 60 can be re-attached to close the port 30. Other attachment types other than mating threads may be used to secure the cap 60 to the port 30.

According to an embodiment of the invention, the biocontainer 12 includes fluid paths 28 (such as tubing, connectors, etc) which enable aseptic connectivity for aseptic transfer of the fluid out of the biocontainer. The fluid paths 28 may be provided at the end of a tube 62 as shown in FIG. 2, to extend the fluid path from the biocontainer. The drain port 36, tubing 62, and fluid paths 28 are in fluid communication with the interior space 24. That is, a fluid path connects the interior space to the connectors 28 through the bottom port 36 and the tube(s) 62. This fluid path enables the fluid within the biocontainer 12 to be drained from the biocontainer and transferred through the fluid paths 28 to an end-use application, such as a bioreactor or other laboratory equipment, without being exposed to the outside environment. The fluid may be provided as an incremental drip from the biocontainer or may be fully dispensed at the outset. The fluid paths 28 which enable aseptic connectivity may be industry-standard aseptic connectors or equipment that uses weldable tubing to form an aseptic fluid connection. The connectors, tubings, and fittings used with the biocontainer may be customized for specific end-user applications.

With the aseptic connectors, the biocontainer 12 is a closed system, meaning that the fluid 18 inside the biocontainer 12 is not exposed to the outside environment, even when it is drained through the drain port and aseptic connectors. The biocontainer may be handled in a non-controlled environment without exposing the fluid 18. In one embodiment, after the fluid has been drained from the biocontainer, the biocontainer is discarded. Optionally, the biocontainer may be re-used to transfer the same fluid. When a new fluid or fluid mixture needs to be transferred, a new biocontainer is used.

In an exemplary embodiment, the biocontainer 12 is made from a polymeric film or multi-layer film, such as a film specifically developed for the pharmaceutical industry, such as a polyethylene film structure employing ethylene vinyl alcohol (EVOH) as a gas barrier material. The polymeric film forms the flexible front and rear faces of the biocontainer. The polymeric film is flexible and is capable of being pre-sterilized such as by gamma radiation. In one embodiment the biocontainer film provides thermal stability, chemical resistance, and low levels of leaching, to provide a robust film for pure fluid transfers.

Figure 3:
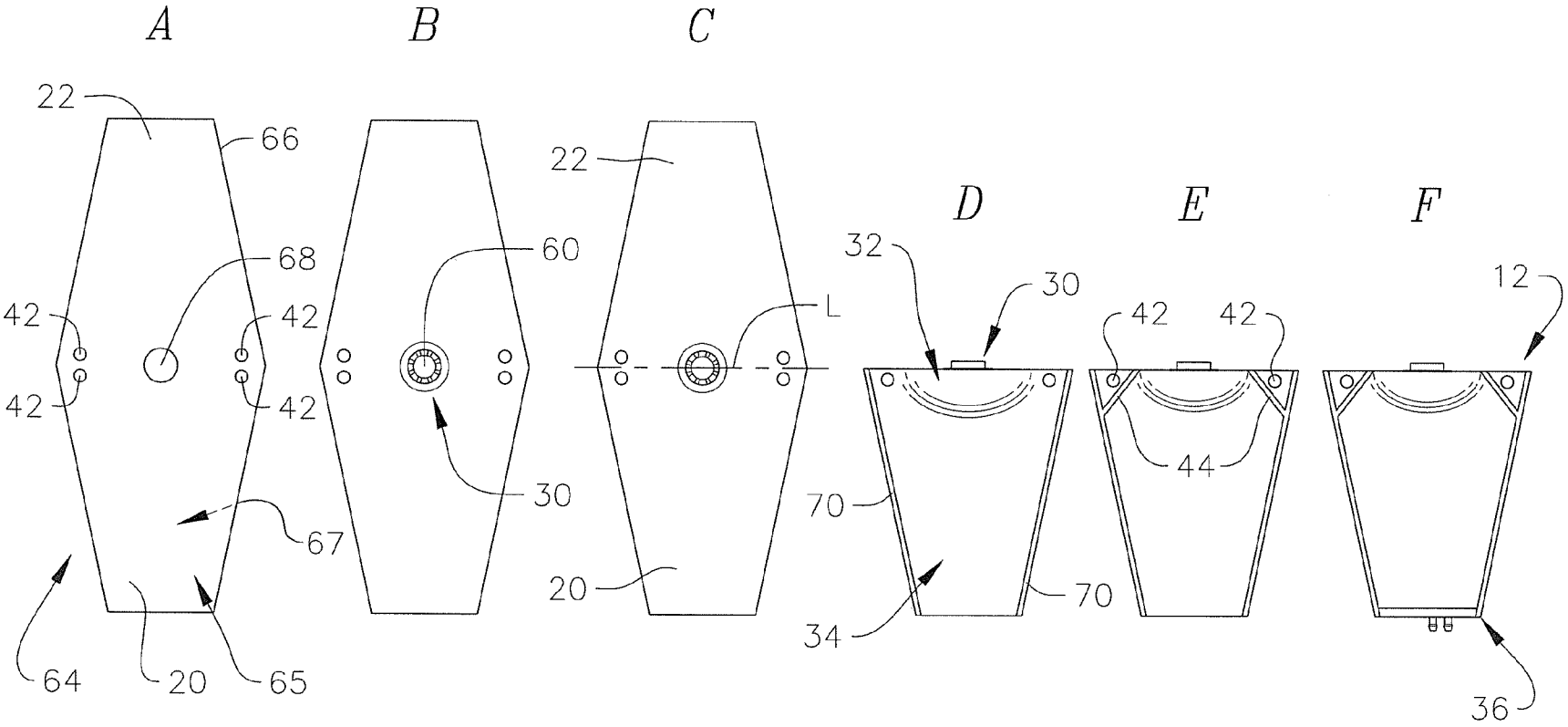
FIG. 3 is a schematic view of a method of manufacturing a biocontainer, according to an embodiment of the invention.

A method of manufacturing a biocontainer according to an embodiment of the invention is shown in FIG. 3. As shown at letter A, a sheet or film 64 includes an outer surface 65 and inner surface 67. The film 64 is trimmed to form a tapered outer perimeter 66. The outer perimeter 66 widens toward the middle of the film 64 and narrows toward the opposite ends. The film 64 is also trimmed to form an opening 68 at the center of the film 64, and four openings 42 on opposite sides of the opening 68. The central opening 68 forms the top port 30, and the four openings 42 form the interface area 40, as described further below. The portion of the film above the opening 68 forms the rear face 22, and the portion of the film below the opening 68 forms the front face 20 ("above" and "below" being in reference only to the orientation of FIG. 3).

As shown at letter B, the top port 30 is attached to the film 64 at the central opening 68. The top port 30 may include a mating screw cap 60, as described above. In one embodiment, the top port 30 is secured to the film 64 by welding.

At letter C, the film 64 is folded along fold line L, bringing the inner surface 65 of the rear face 22 and the inner surface of the front face 20 toward each other. The fold line L passes between the pairs of openings 42 on each side of the fill port 30. The fold line L intersects the top port 30. In one embodiment, the fold line L bisects the central opening 68 in the film 64.

As shown at letter D, the film 64 is folded about the fold line L to bring the rear face 22 and front face 20 together, with the inner surfaces 67 facing each other. The two faces 20, 22 contact each other in the lower portion 34. Above the lower portion 34, the two faces 20, 22 diverge from each other to opposite sides of the top port 30, forming the void 32.

Also shown at letter D, when the film 64 is folded about the fold line L, the pairs of openings 42 on each side of the port 30 align to provide an opening through both faces 20, 22. The two faces 20, 22 are aligned and then sealed together along their perimeter 66, forming a perimeter seam 70 on each side of the faces 20, 22. In one embodiment, the seam 70 is formed by welding, such as heat-welding, forming linear welds 70. In another embodiment, the seam 70 is formed by sealing, heat-sealing, or otherwise bonded together such as by application of heat and/or pressure. Conventional sealers, e.g. thermal impulse or constant heat sealers, can be used for the welding process.

As shown at letter E, additional seams 44 are faulted, sealing the front and rear faces 20, 22 to each other to divide the openings 42 from the interior space 24. The seams 44 seal the interior space 24 and delineate the ears 41, which interface with the support stand as described above. At letter F, the bottom end of the biocontainer is sealed with a drain port 36 such as a boat port. A boat port is shown as one option, but other types of drain ports may be provided, e.g. tube stub porting. Alternatively, the bottom end of the biocontainer may be sealed by sealing the front and rear faces to each other, without any porting, as described below with respect to FIG. 8.

A shown in FIG. 3, in one embodiment, a method for manufacturing a biocontainer includes forming the front and rear faces from the same piece of film 64, rather than from two distinct or separate pieces of film. The front and rear faces are created by folding a single integral piece of film, and the front and rear faces are integrally connected to each other through the fold line L. The division between the front and rear faces is created by the integral fold line L, rather than a seam joining two separate pieces. In another embodiment, two separate pieces of film may be provided for the front and rear faces and may be welded together to create the shape of the biocontainer 12.

In one embodiment, the biocontainer assembly 10 is sterilized prior to delivery to the end user. The biocontainer assembly may be sterilized by gamma radiation.

Figure 4:
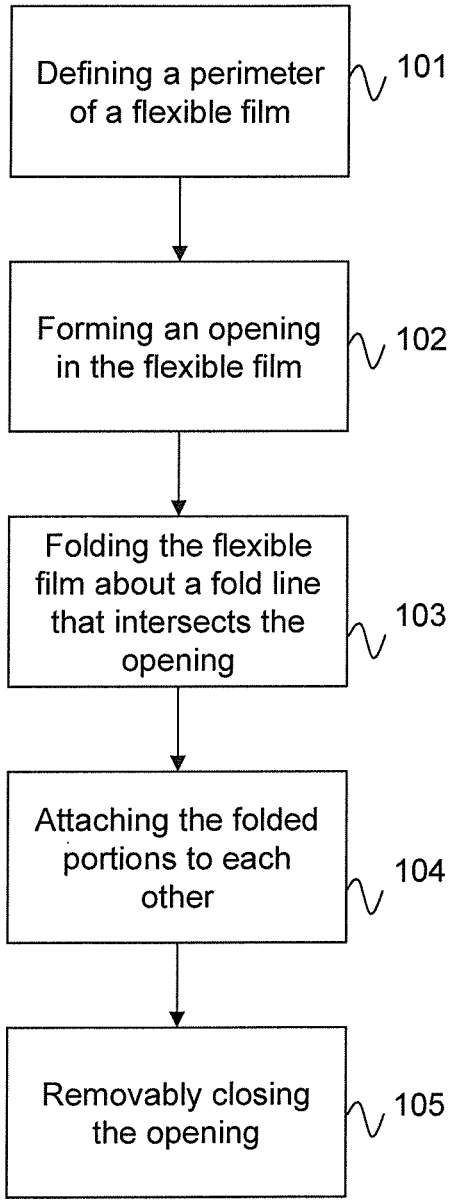
FIG. 4 is a flowchart of a method of manufacturing a biocontainer, according to an embodiment of the invention.

A method for manufacturing a biocontainer according to an embodiment of the invention is shown in the flowchart of FIG. 4. The method includes defining a perimeter of a flexible film (101), such as the perimeter 66 of the film 64 shown in FIG. 3. The method also includes forming an opening in the flexible film (102), such as the opening 68 shown in FIG. 3. The method also includes folding the flexible film about a fold line that intersects the opening (103). An example is shown in FIG. 3, where the film 64 is folded about fold line L, which intersects the central opening 68 where the top port 30 is attached. The folded film includes a front portion and a rear portion facing each other, folded toward each other about the fold line L. Referring again to FIG. 4, the method includes attaching the folded portions to each other (104), such as by welding. The method also includes removably closing the opening (105), such as by providing a port with a screw cap. Optionally, other ports, fittings, tubings, or connectors may be provided as well, such as a drain port and/or one or more mixing ports.

Figure 5:
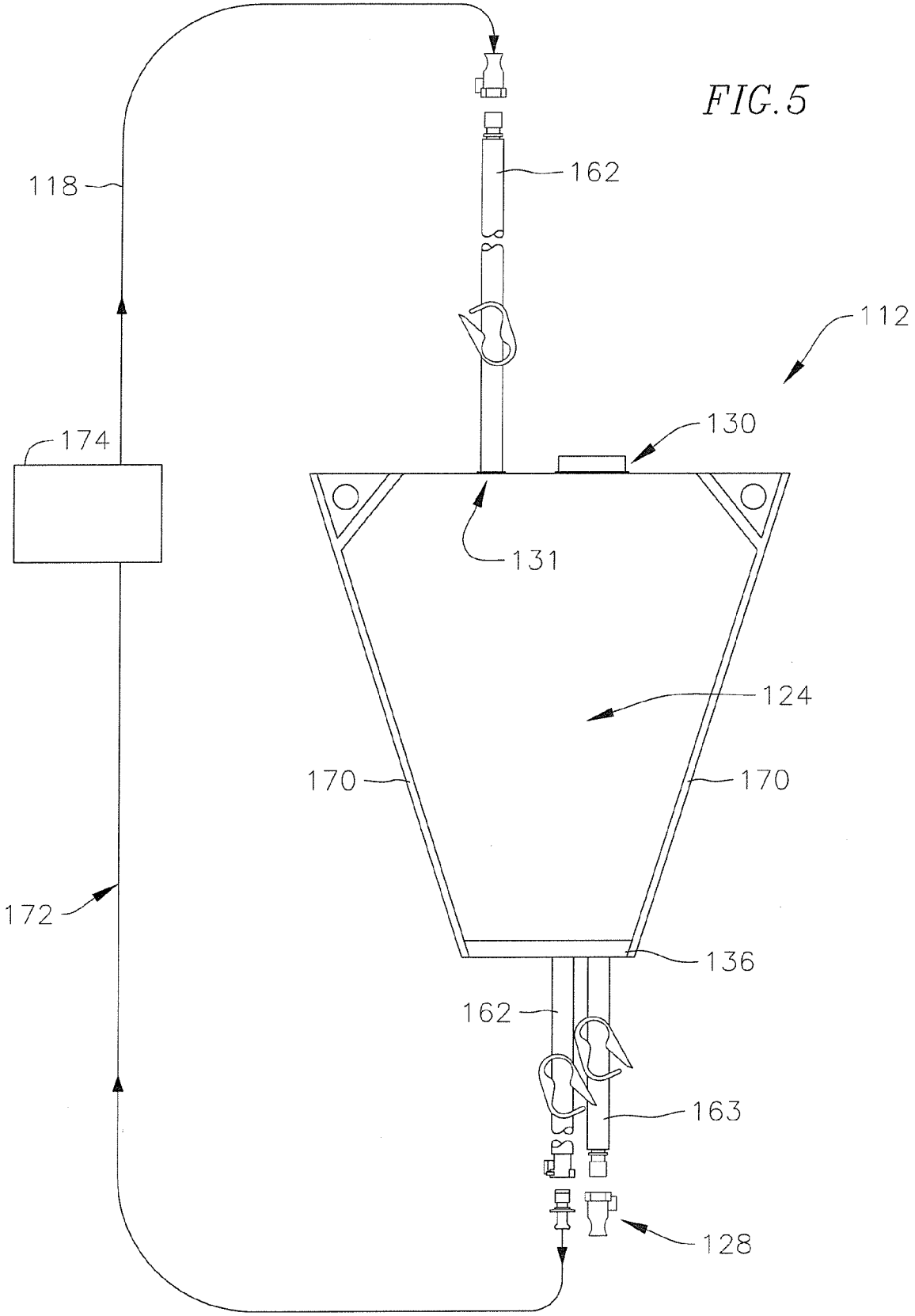
FIG. 5 is a front view of a biocontainer assembly including a liquid flow loop, according to an embodiment of the invention.

According to embodiments of the invention, a flexible biocontainer can be used for mixing pharmaceutical fluids, such as fluid-fluid mixing, powder-fluid mixing (or rehydration), and/or fluid recirculation. A biocontainer assembly 112 according to an embodiment is shown in FIG. 5. The biocontainer assembly 112 includes a fill port 130 at or near the top of the biocontainer assembly 112, and a drain port 136 at or near the bottom of the biocontainer assembly 112. The fill port 130 may be used to fill the biocontainer assembly 112 with an initial component, such as a fluid or a powder. This component may be filled into the initial void in the biocontainer through the fill port 130. During powder mixing or rehydration, a powder and a fluid may both be filled into the biocontainer assembly 112. The powder may be, for example, a dehydrated media.

After filling the biocontainer, it may be desired to circulate the fluid to promote mixing. For example, a circulation flow loop 172 for a fluid 118 is shown schematically in FIG. 5. To accommodate this circulation, the biocontainer 112 includes a second top port 131, which may be referred to as a mixing or recirculation port. Tubing 162 is connected to the drain port 126 and the mixing port 131 to form the fluid flow loop 172. A peristaltic pump 174 is provided in the flow loop 172 to force the fluid 118 to circulate through the loop. The flow loop passes through the tubing 162 and through the interior space 124 inside the biocontainer 112. The fluid 118 is circulated through the loop 172 by the pump 174 to achieve sufficient mixing and/or aeration of the fluid 118. For example, the fluid may be mixed with a powder component by introducing both the fluid and powder into the interior space 124 and then circulating the components through the flow loop 172. The liquid may be circulated in either direction (clockwise or counter-clockwise in the figure) through the flow loop 172, depending on the components being mixed. When a powder heavier than water (such as a salt) is being mixed, flow may be counter-clockwise (upward through the biocontainer). When a powder lighter than water is being mixed, flow may be clockwise (downward through the biocontainer).

When mixing is achieved, the drain port 136 may be closed and the tubing 162 removed or disconnected. Optionally, another set of tubing 163 may be provided to drain the fluid 118 from the biocontainer 112 to the appropriate destination. As before, fluid paths which enable aseptic connectivity 128 are provided to provide an aseptic fluid path even in a non-sterile environment.

Figure 6:
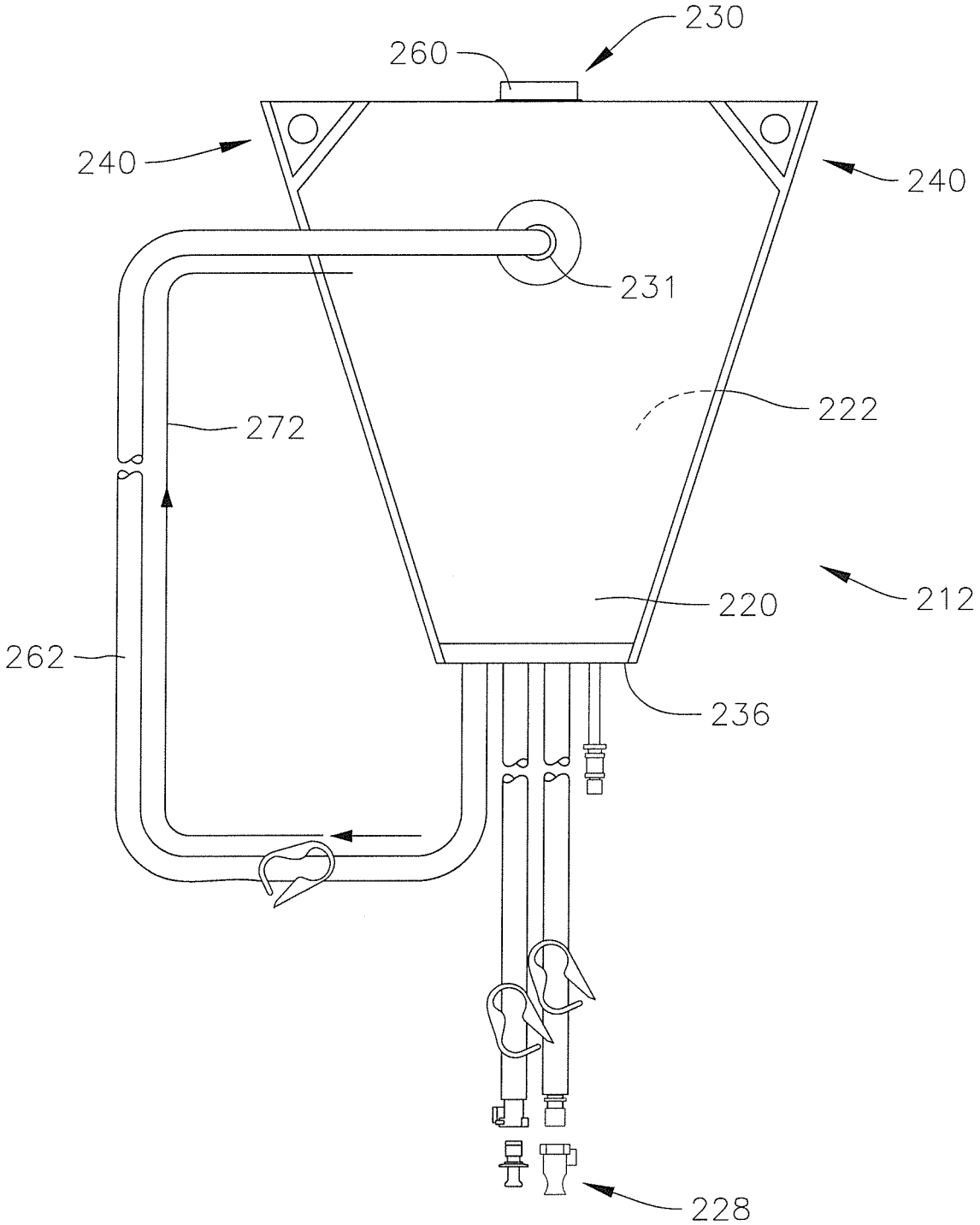
FIG. 6 is a front view of a biocontainer assembly including a liquid flow loop, according to an embodiment of the invention.

In FIG. 5, the mixing port 131 is provided at the intersection of the front and rear faces 120, 122 of the biocontainer 112. The fill port 130 is also located at the intersection of the front and rear faces, as before. In this embodiment, the fill port 130 is offset to the right side of the biocontainer (as oriented in the figure), toward one of the side seams 170, to accommodate the mixing port 131. Other shapes and configurations of the biocontainer and mixing ports and tubes are possible. For example, a biocontainer 212 according to an embodiment is shown in FIG. 6. In this embodiment, the mixing port 231 is located on the front face 220 of the biocontainer, rather than at the intersection of the front and rear faces. Additional tubes and connectors are provided from the drain port 236. As before, the fill port 230 is located at the top of the biocontainer, between the front and rear faces 220, 222. These components are shown as examples only, and many other combinations and configurations are possible.

Figure 7:
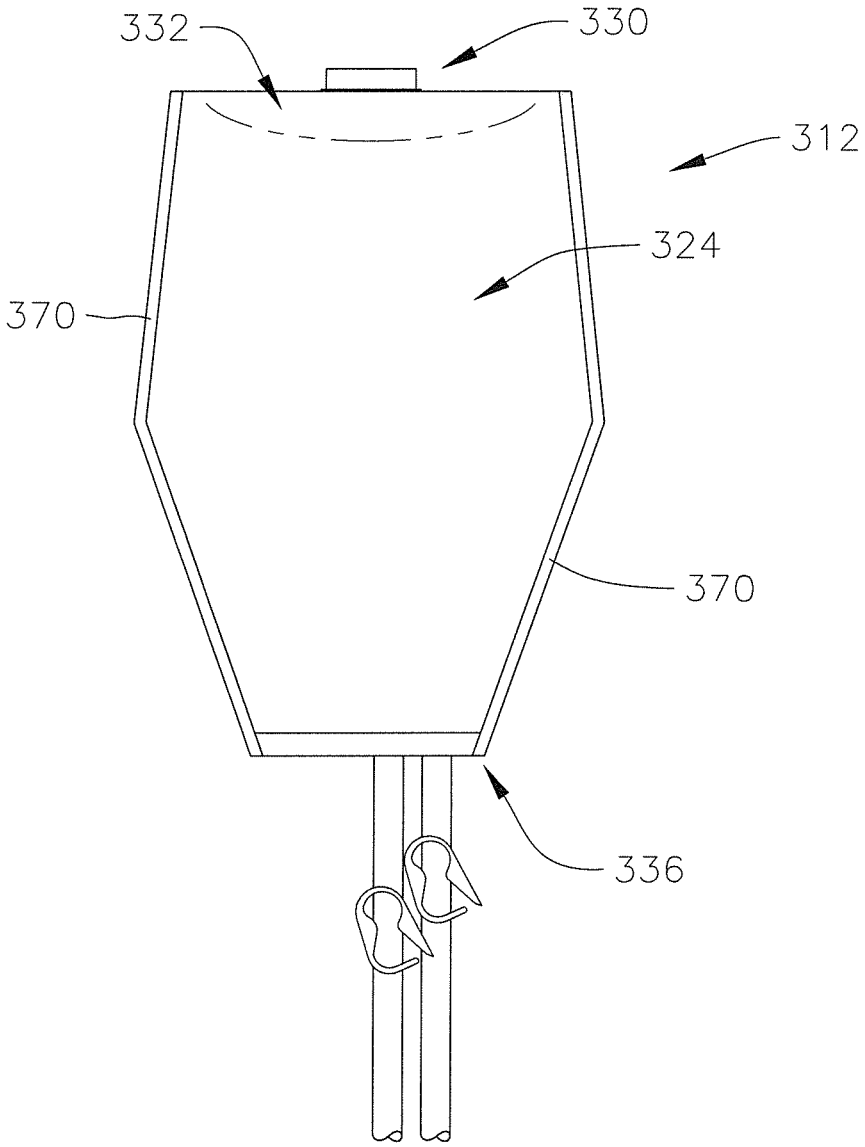
FIG. 7 is a front view of a biocontainer assembly according to an embodiment of the invention.

A biocontainer 312 according to another embodiment is shown in FIG. 7. In this embodiment, the biocontainer 312 has an extended shape to provide a larger volume in the interior space 324. The biocontainer 312 includes a fill port 330 and drain port 336 as before, and a set of tubes or connectors as needed for the particular fluid process. Additionally, the biocontainer 312 may omit the interface area 40 (FIG. 2) that is used to support the biocontainer on a stand. In the embodiment of FIG. 7, the biocontainer 312 may simply be lifted by the user, or may be supported by other types of supporting stands or shelves. Due to the larger interior volume of the biocontainer 312, the seams 370 on the sides of the biocontainer 312 may be increased in size (as compared to seals on smaller biocontainers) or reinforced. In one embodiment, the seams 370 are formed by compound welding. In one embodiment, the biocontainer 312 includes an interior space 324 with a volume of about 20 Liters. For comparison, in one embodiment, the biocontainer 12 of FIG. 1 provides an interior space with a volume between about 500 mL to 6 Liters. In other embodiments, biocontainers of various sizes are provided, ranging from 500 mL to 20 Liters.

Figure 8:
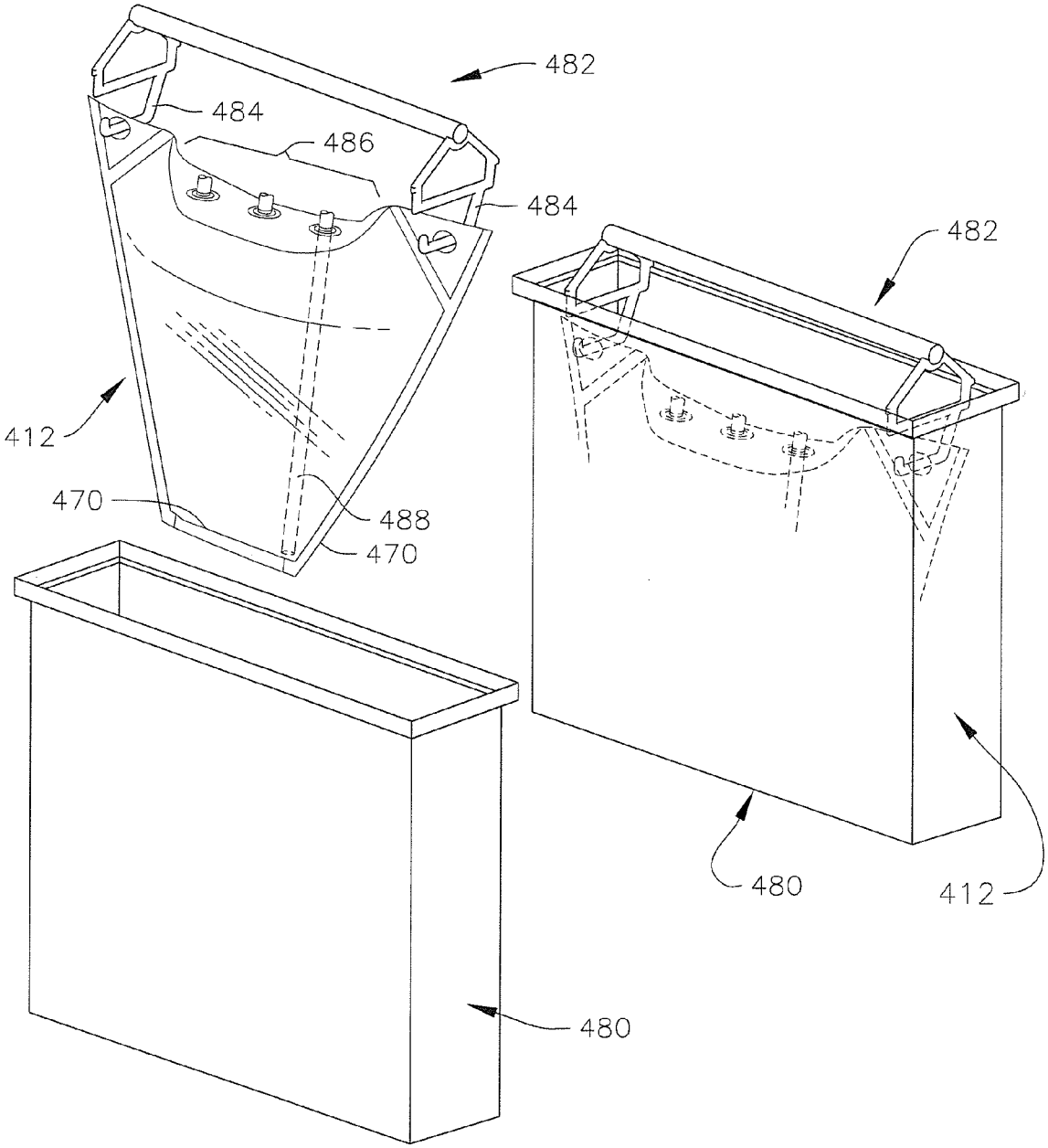
FIG. 8 is an exploded perspective view of a biocontainer assembly and tank according to an embodiment of the invention.

A biocontainer 412 according to an embodiment of the invention is shown in FIG. 8, in connection with a protective outer tank 480 and hanger 482. The outer tank is used to provide additional shielding and leak protection to the biocontainer 412, such as when the biocontainer 412 includes hazardous substances, or when the biocontainer 412 is being transported. The hanger 482 includes aims 484 that pass through openings 442 in the biocontainer, to hang the biocontainer from the hanger. The tank 480 supports the hanger 482 such that the biocontainer is suspended within the interior of the outer tank 480.

FIG. 8 also shows another configuration of ports and tubing for the biocontainer. In the embodiment of FIG. 8, the biocontainer 412 includes three ports 486 at the top of the container, and a seam 470 at the bottom. The biocontainer does not include bottom porting, in this embodiment. A dip tube 488 is connected to one of the ports 486, and the tube extends downwardly through the interior space 424 of the biocontainer to the bottom seam 470. The dip tube 488 may be used to evacuate the contents of the biocontainer 412 through the tube 488 by suction applied by a pump. The other top ports provide filling and venting functionality. The bottom of the biocontainer 412 is sealed, such as by welding the edges of the front and rear faces together.

According to an embodiment of the invention, a flexible biocontainer includes a blended two- and three-dimensional shape. The upper portion of the biocontainer includes a three-dimensional shape for filling, and the bottom portion of the biocontainer includes a two-dimensional shape for draining. The biocontainer has a tapered or funnel shape, sloping between the two dimensional bottom portion to extend to the three-dimensional top portion.

In one embodiment, to create this blended shape, the biocontainer is folded about the fill port. The fill port is located at the intersection of the front and rear faces of the biocontainer. The front and rear faces are symmetric about the fold line L (FIG. 3), and the fill port is located on the fold line. The fill port may be offset along this fold line closer to one side of the biocontainer than the other (see, for example, FIG. 5), or it may be centered on the fold line (see, for example, FIG. 2). In one embodiment, the fill port (30, 130, etc) is positioned between the top edges 70*a*, 70*b* of the two side seams (see FIG. 2). That is, rather than being positioned along one of the faces 20, 22, between the long sides of the seams 70, the fill port is located at the top of the biocontainer, between the top edges 70*a*, 70*b* of the seams 70.

Figure 9:
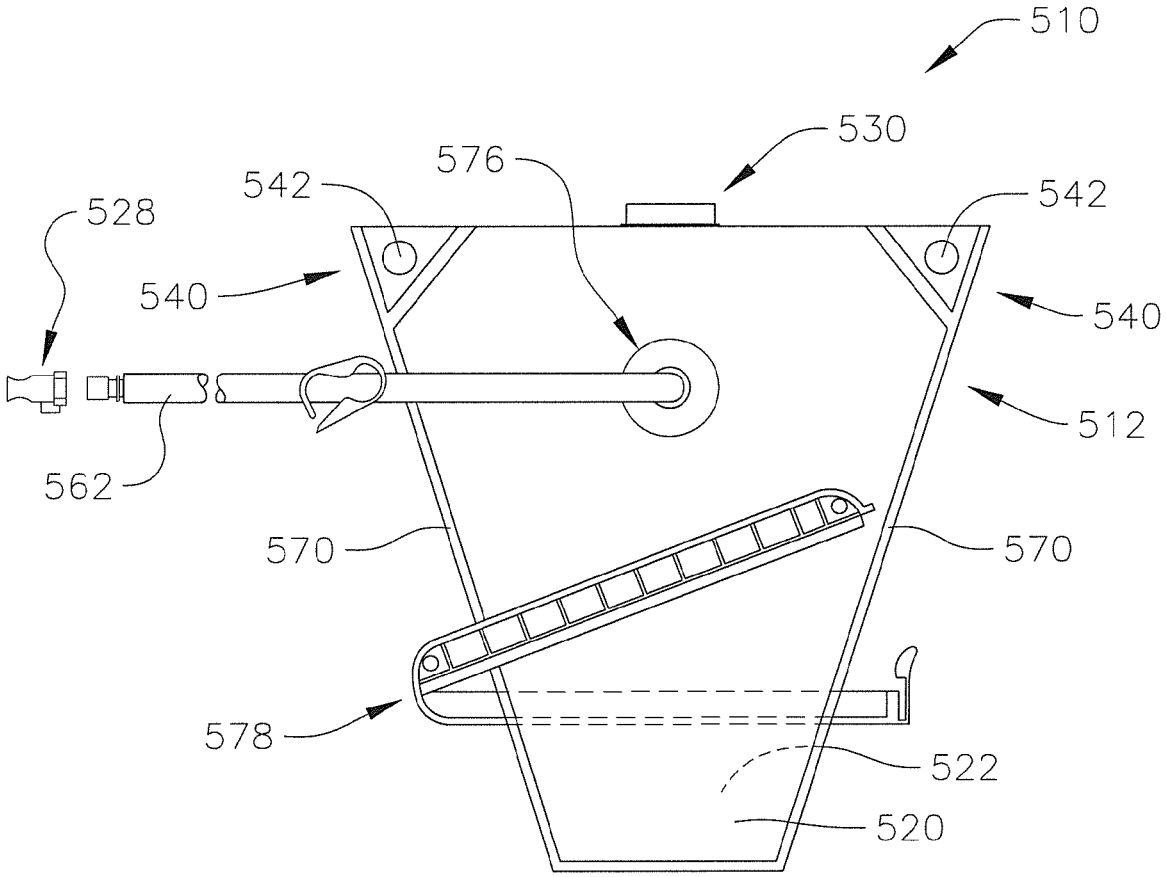
FIG. 9 is a front view of a biocontainer assembly according to an embodiment of the invention.

A biocontainer assembly 510 according to an embodiment of the invention is shown in FIG. 9. In this embodiment, the biocontainer assembly 510 is utilized for separating particulates from a fluid. In various applications, it may be necessary to separate particulates from a fluid solution or suspension, by allowing the particulates to settle to the bottom of the biocontainer. The biocontainer assembly 510 in FIG. 9 facilitates this process, enabling the particulate-free fluid to be withdrawn from the biocontainer after the particulates have settled.

As shown in FIG. 9, the biocontainer assembly 510 includes a biocontainer 512 formed from a front face 520 and a rear face 522 joined together at seams 570. The biocontainer 512 includes a fill port 530 at the top of the biocontainer, creating a three-dimensional fill space, as described above. The biocontainer 512 also includes interfaces 540 with openings 542 for hanging the biocontainer on a stand, such as stand 14 (see FIG. 1). Referring again to FIG. 9, the biocontainer 512 also includes a face port 576 on the front face 520 of the biocontainer, connected to tubing 562. The tubing 562 may include connectors or ends 528 that enable an aseptic fluid path from the biocontainer.

In the embodiment shown, the biocontainer assembly 510 also includes a clamp 578 which is sized to fit across the biocontainer 512 and clamp the biocontainer shut, squeezing the front face 520 and rear face 522 together to contact each other. In use, the clamp 578 is secured to the biocontainer 512 after the particulates have settled to the bottom of the biocontainer. The clamp isolates the settled particulates from the rest of the fluid and maintains the separation until a fluid recovery process is initiated. The particulate-free fluid can then be drawn out of the biocontainer through the face port 578 and tubing 562.

In one embodiment, the biocontainer assembly 510 is used to separate cell debris from the surrounding fluid in which the cells are suspended. The cells settle to the bottom of the biocontainer 512, and the fluid is then drawn out through the face port 576. In other embodiments, it may be desired to retain the settled particulate, which can be removed through a bottom port (not shown in FIG. 9) in the biocontainer 510. For example, a chemical reaction between fluids may create a desired particulate, which settles to the bottom of the biocontainer 510 to be collected.

The biocontainer 512 has a tapered shape, forming a three-dimensional shape at the top end and a two-dimensional shape at the bottom end, as described in more detail above. The tapered shape of the biocontainer 512 facilitates the separation process, efficiently collecting the particulates at the bottom of the bag, separated from the clear fluid above. Either the clear fluid or the particulates themselves (or both) may then be collected for further use.

According to an embodiment, the flexible biocontainer enables aseptic transfer of sterile bottled fluids to laboratory equipment in non-sterile laboratory environments. The flexible biocontainer can also be used to measure and/or mix pharmaceutical process fluids. In one embodiment, a fluid is filled into the biocontainer from a supply source, transferred within the biocontainer to an end-use application, and then delivered from the biocontainer for use. The biocontainer may be used for process fluids in cell culture applications, drug synthesis, chromatography, and other processes. In various embodiments, the biocontainer also provides for mixing and/or recirculation of a fluid, such as for mixing powder and fluid components. The biocontainer provides an aseptic fluid path for aseptic transfer of a fluid in a non-sterile environment.

Although the present invention has been described and illustrated in respect to exemplary embodiments, it is to be understood that it is not to be so limited, since changes and modifications may be made therein which are within the full intended scope of this invention as hereinafter claimed.

What is claimed is:

1. A biocontainer assembly for the transfer of pharmaceutical fluids, the biocontainer assembly comprising:

a flexible layer folded about a fold line defining a front face and a rear face, wherein the front face and the rear face are facing each other to define an interior space between them;

a seam along which the front and rear faces are connected to each other to close the interior space;

a fill port fluidically communicating with the interior space, wherein the fill port is intersected by the fold line, wherein the fold line defines an end of said biocontainer assembly; and a drain port opposite the end and between the front and rear faces, wherein a portion of the flexible layer extends transversely from the front to the rear face, and wherein said portion of the flexible layer is intersected by said fold line.

2. The biocontainer assembly of claim 1, wherein the front and rear faces are separated from each other to create a void below the fill port.

3. The biocontainer assembly of claim 1, wherein the fill port comprises a three-dimensional port, and the drain port comprises a two-dimensional port.

4. The biocontainer assembly of claim 1, wherein the front and rear faces comprise aligned openings for interfacing with a support stand.

5. The bio container assembly of claim 1, wherein the front and rear faces and the seam define a tapered shape.

6. The biocontainer assembly of claim 1, further comprising a clamp for clamping the front and rear faces together to isolate a bottom portion of the interior space.

7. The biocontainer assembly of claim 1, further comprising a pharmaceutical fluid occupying the interior space.

8. The biocontainer as recited in claim 1, comprising a pair of ears formed from said front face and rear face for coupling with a support.

9. The biocontainer as recited in claim 8, wherein an opening is defined through each ear for receiving a rod through of the support.

10. The biocontainer assembly of claim 1, wherein the fill port penetrates said portion of the flexible layer.

11. The biocontainer assembly of claim 1, wherein the drain port allows for drainage by gravity.

12. A method for manufacturing a biocontainer assembly for the transfer of pharmaceutical fluids, comprising:

defining a perimeter of a flexible film;

forming an opening in the flexible film;

folding the flexible film about a fold line that intersects the opening, the fold line defining front and rear folded portions;

attaching the front and rear folded portions to each other to define an interior space below said fold line; and moving a portion of the flexible film including at least a portion of the folding line to a position transverse to said front and rear folded portions.

13. The method of claim 12, further comprising removably closing the opening.

14. The method of claim 12, wherein defining a perimeter of the film comprises forming a tapered perimeter.

15. The method of claim 12, wherein attaching the front and rear folded portions to each other comprises welding.

16. The method of claim 12, wherein the fold line bisects the opening.

17. The method of claim 13, wherein removably closing the opening comprises attaching a port to the film at the opening and capping the port with a removable cap.

18. The method of claim 12, wherein attaching the front and read folded portions comprises attaching said portions along at least a portion of their perimeters.

19. The method of claim 18, further comprising attaching a boat port to a portion of said perimeter of each of said front and rear folded portions between said front and rear folded portions defining a lower end of said biocontainer.

20. The method as recited in claim 18, comprising forming a first opening through said front folded portion and a second opening through said rear folded portion.

21. The method as recited in claim 20, wherein the openings are formed before folding.

22. The method as recited in claim 20, wherein the openings are outside of said interior space.

23. The method of claim 12, wherein moving a portion comprises moving a portion of the flexible film including said opening.

* * * * *

UNITED STATES PATENT AND TRADEMARK OFFICE

CERTIFICATE OF CORRECTION

PATENT NO. : 8,926,923 B2
APPLICATION NO. : 13/472380
DATED : January 6, 2015
INVENTOR(S) : Max D. Blomberg It is certified that error appears in the above-identified patent and that said Letters Patent is hereby corrected as shown below:

In the Claims

| | |
|---|---|
| Col. 10, line 55, Claim 5 | Delete "bio container",<br>Insert --biocontainer-- |
| Col. 12, line 7, Claim 18 | Delete "read folded",<br>Insert --rear folded-- |

Signed and Sealed this
Second Day of August, 2016

Michelle K. Lee

Michelle K. Lee
*Director of the United States Patent and Trademark Office*